US009228312B2

(12) United States Patent
Smith

(10) Patent No.: US 9,228,312 B2
(45) Date of Patent: Jan. 5, 2016

(54) METHOD OF BUILDING A STRUCTURE IN THE PRESENCE OF WATER

(76) Inventor: Murray Smith, Beaverlodge, CA (US)

( * ) Notice: Subject to any disclaimer, the term of this patent is extended or adjusted under 35 U.S.C. 154(b) by 21 days.

(21) Appl. No.: 13/590,437

(22) Filed: Aug. 21, 2012

(65) Prior Publication Data

US 2013/0051926 A1 Feb. 28, 2013

(30) Foreign Application Priority Data

Aug. 25, 2011 (CA) ..... 2751052

(51) Int. Cl.

| | |
|---|---|
| ***E02D 29/05*** | (2006.01) |
| ***E02D 27/12*** | (2006.01) |
| ***E01F 5/00*** | (2006.01) |
| ***E02D 29/055*** | (2006.01) |

(52) U.S. Cl.

CPC ..... *E02D 27/12* (2013.01); *E01F 5/005* (2013.01); *E02D 29/05* (2013.01); *E02D 29/055* (2013.01)

(58) Field of Classification Search

USPC ..... 405/15, 80, 195.1, 218, 36

See application file for complete search history.

(56) References Cited

U.S. PATENT DOCUMENTS

| | | | | |
|---|---|---|---|---|
| 518,648 | A * | 4/1894 | Hopler | 405/124 |
| 4,011,726 | A | 3/1977 | Cooper, Jr. | |
| 6,151,743 | A * | 11/2000 | Church et al. | B29C 53/585 14/73 |
| 6,334,736 | B1 * | 1/2002 | Johnson et al. | 405/114 |
| 2003/0035690 | A1 * | 2/2003 | Earl | 405/107 |

FOREIGN PATENT DOCUMENTS

| | | | |
|---|---|---|---|
| DE | 4418515 | A1 * | 11/1995 |
| JP | 07238528 | A * | 9/1995 |

* cited by examiner

*Primary Examiner* — Tara M. Pinnock
*Assistant Examiner* — Kyle Armstrong
(74) *Attorney, Agent, or Firm* — Davis & Bujold, P.L.L.C.; Michael J. Bujold

(57) ABSTRACT

A method of building a structure in the presence of water includes providing two or more three-sided elongated triangular bodies that has a first end, a second end, and an internal flow passage that extends between the first end and the second end. Each of the triangular bodies has an apex with a base opposed to the apex. Each of the triangular bodies is positioned in side by side relation, with the flow passage of one or more of the triangular bodies serving as a flow path for water. A road, a bridge or a dock is positioned transversely across the triangular bodies.

10 Claims, 5 Drawing Sheets

METHOD OF BUILDING A STRUCTURE IN THE PRESENCE OF WATER

FIELD

The building method described was developed to build structures where water is present, such as docks, bridges and roads over streams.

BACKGROUND

U.S. Pat. No. 4,011,726 (Cooper Jr.) entitled "Delta Culvert" describes a three sided culvert, with sides connected with interlocking joints. The Cooper Jr. reference also describes background prior art on triangular culvert structures, used when roads must cross streams or drainage ditches.

SUMMARY

There is provided a method of building a structure in the presence of water that includes providing two or more three-sided elongated triangular bodies that have a first end, a second end, and an internal flow passage that extends between the first end and the second end. Each of the triangular bodies has an apex with a base opposed to the apex. Triangular bodies are positioned in side by side relation with the flow passage of one or more of the triangular bodies serving as a flow path for water. A road, a bridge or a dock is positioning transversely across the triangular bodies.

Each of the triangular bodies may rest on the base with the apex of each of the triangular bodies extending upwardly. It is also possible that the orientation of the triangular bodies may alternate with the apex of one triangular body extending upwardly and the apex of an adjacent triangular body extending downwardly. Each of the triangular bodies has a longitudinal axis and positioning of the triangular bodies is closely spaced with the longitudinal axis of each of the triangular bodies in parallel spaced relation.

For ease of shipping, movement and set up, each triangular body may be comprised of three discrete slabs that have side edges with interlocking profiles and a step is taken of interlocking the interlocking profiles of the side edges to form the triangular bodies. Each of interlocking profiles is preferably a dog-clutch engagement with teeth which engage slots. A further step may be taken of extending fasteners transversely through the teeth of one slab and into a bottom of a slot of another slab to maintain the teeth engaged with the slots. The interlocking profiles ensure that the discrete slabs maintain their position when connected to form the triangular bodies and subjected to loads caused by a road, bridge or dock.

In order to achieve a desired length, each of the slabs may include more than one slab segment and a step is taken of positioning the slab segments in end to end relation to create the slab. A joint is created whenever one slab segment abuts another slab segment in end to end relation, and a step is taken of offsetting the joints connecting the slab segments of one of the three discrete slabs relative to the joints connecting the slab segments on other of the three discrete slabs. This helps to increase the strength and stability of the structure, as it prevents a common peripheral joint which could become a weak point.

With prior art construction using circular culverts, the road had to traverse the culvert at 90 degrees. With the method described, the road, bridge or dock may traverse the triangular bodies at any angle, including an angle of less than 90 degrees or an angle of more than 90 degrees.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A prior art method of building a structure in the presence of water, will now be described with reference to FIG. 7 through 8.

Figure 7:
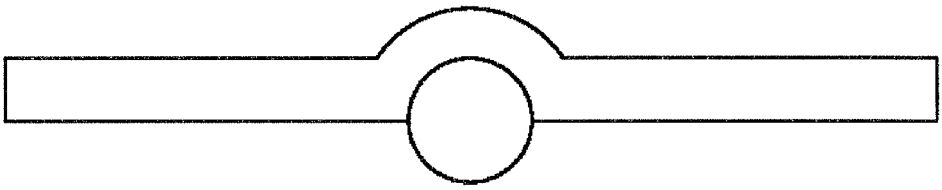
PRIOR ART FIG. 7
FIG. 7, labelled as PRIOR ART, is a side elevation view of a prior art structure in the presence of water.
Figure 8:
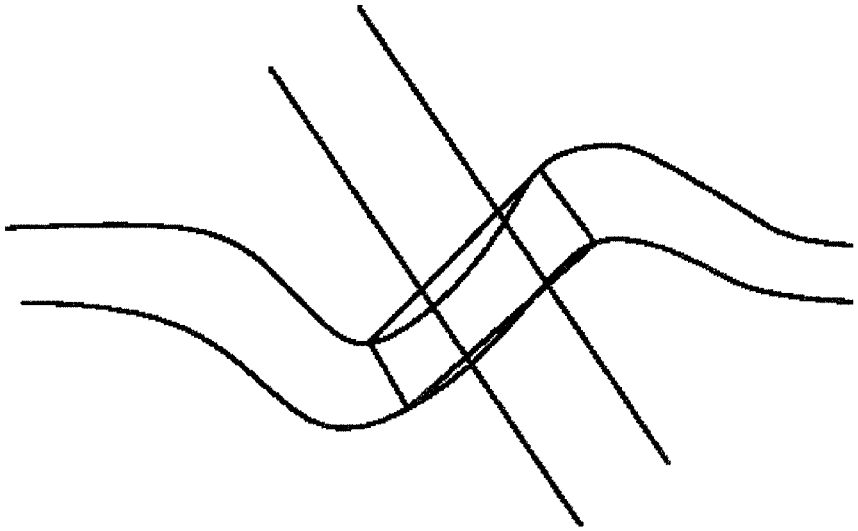
PRIOR ART FIG. 8
FIG. 8, labelled as PRIOR ART, is a top elevation view of the prior art structure shown in FIG. 7.

Referring to FIG. 7, the most common type of culvert presently employed is a round tubular culvert. As will hereinafter be further described, this form of culvert requires a higher elevation of road grade. Referring to FIG. 8, the method of installation requires alignment to the stream bed or river bed.

A method of building a structure in the presence of water, will now be described with reference to FIG. 1 through 6.

Figure 1:
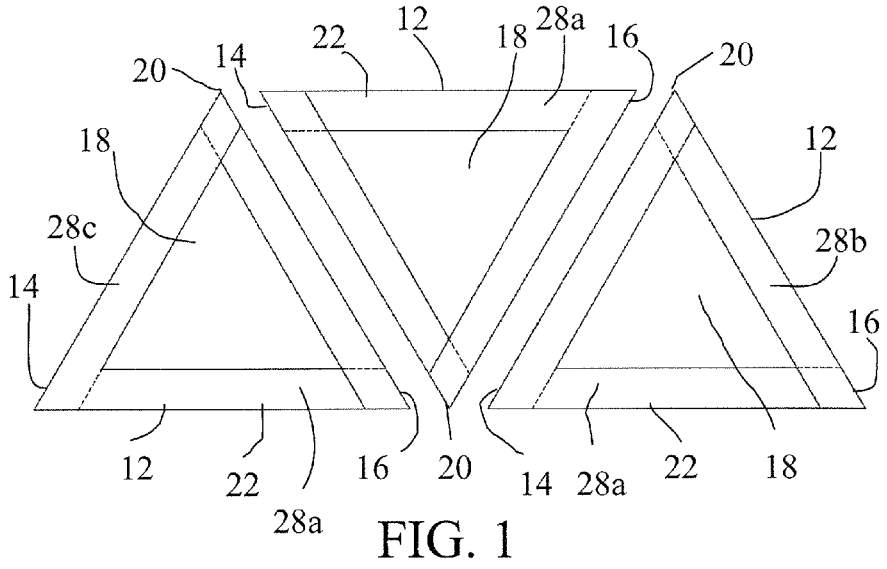
FIG. 1 is an end view of triangular bodies used in building a structure in the presence of water in different orientations.
Figure 5:
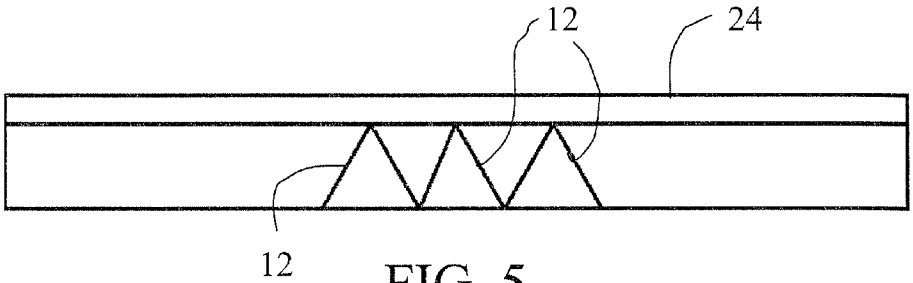
FIG. 5 is a side elevation view of a completed structure in the presence of water.
Figure 6:
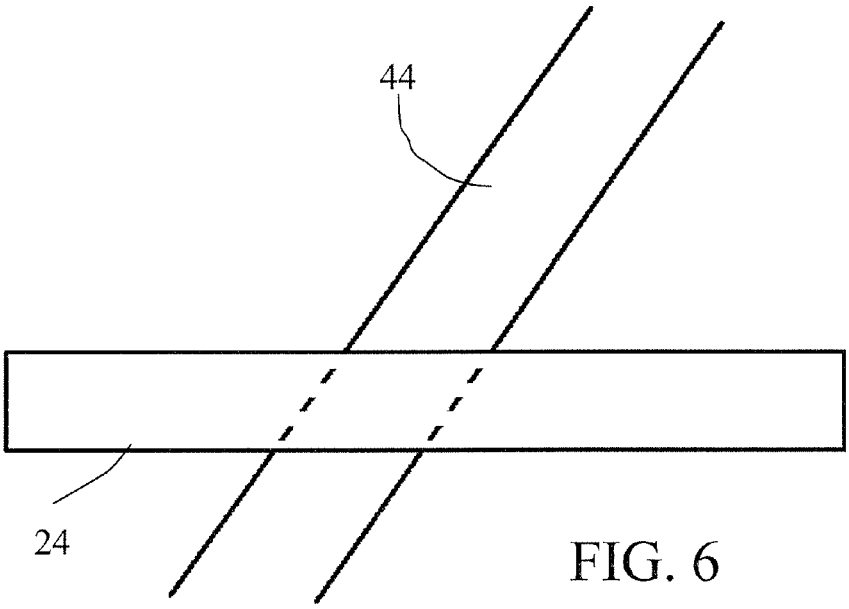
FIG. 6 is a top elevation view of the completed structure shown in FIG. 5.

Structure and Relationship of Parts:

Referring to FIG. 1, the method includes providing two or more three-sided elongated triangular bodies 12 that have a first end 14, a second end 16, and an internal flow passage 18 that extends between first end 14 and second end 16. Each of triangular bodies 12 has an apex 20 with a base 22 opposed to apex 20. Each of triangular bodies 12 is positioned in side by side relation with flow passages 18 of one or more of triangular bodies 12 serving as a flow path for water. Referring to FIG. 5 and FIG. 6, a road, a bridge or a dock 24 is then positioned transversely across triangular bodies 12. Road, bridge or dock 24 may traverse triangular bodies 12 at any angle. Whereas the PRIOR ART was always at 90 degrees, the angle could be less than 90 degrees or more than 90 degrees in relation to the triangular bodies 12.

Figure 2:
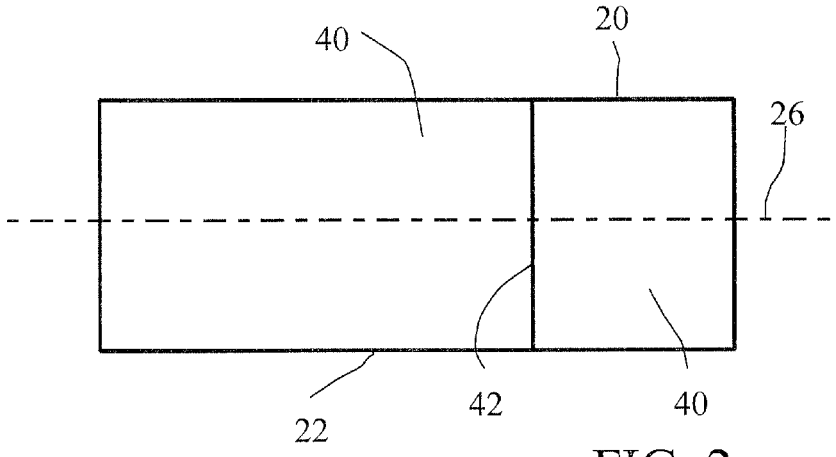
FIG. 2 is a side elevation view of the triangular bodies shown in FIG. 1.

Referring to FIG. 5, each triangular body 12 may rest on base 22 with apex 20 of each triangular body 12 extending upwards. Referring to FIG. 1, orientation of triangular bodies 12 may be alternated with apex 20 of one triangular body 12 extending upwardly and apex 20 of an adjacent triangular body 12 extending downwards. Referring to FIG. 2, each of triangular bodies 12 has a longitudinal axis 26. Referring to FIG. 5, the positioning of triangular bodies 12 is closely spaced with longitudinal axis 26 of each triangular body 12 in parallel spaced relation.

Figure 3:
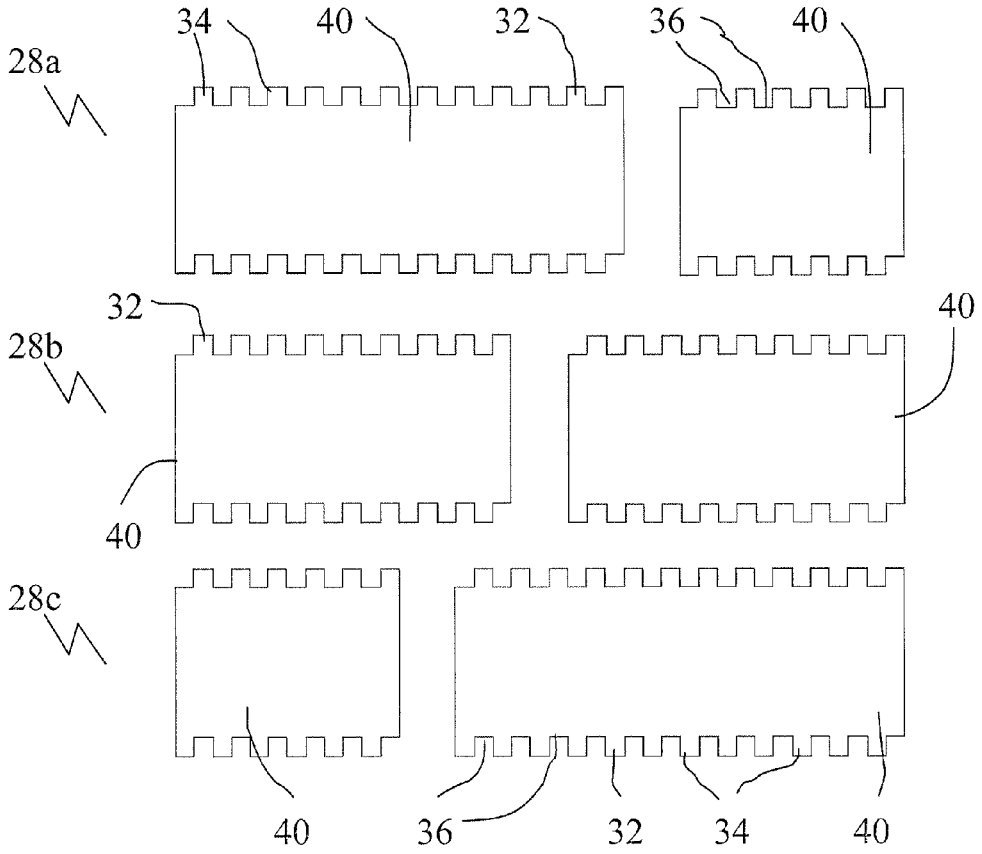
FIG. 3 is an exploded top plan view of slab segments for slabs which make up the triangular bodies shown in FIG. 1.
Figure 4:
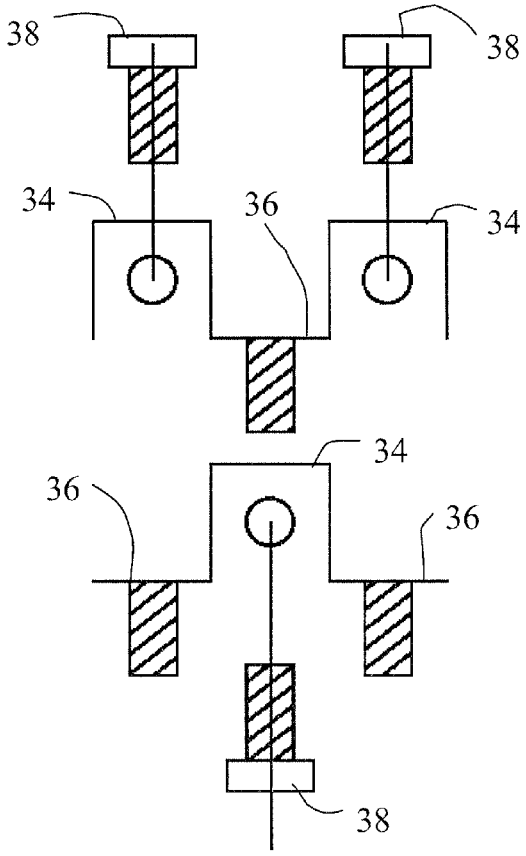
FIG. 4 is a detailed view of an interlocking profile for connecting the slabs shown in FIG. 3.

Referring to FIG. 3, each of triangular bodies 12 may be made of three discrete slabs 28*a*, 28*b* and 28*c* that have side edges 30 with interlocking profiles 32. Referring to FIG. 4, interlocking profiles 32 are interlocked at side edges 30 to form triangular bodies 12. Each of interlocking profiles 32 may be a dog-clutch engagement that has teeth 34 which engage slots 36 or may be any other type of interlocking engagement or profile. In order to ensure that the dog-clutch engagement does not become disengaged due to frost heaving or other ground movement, a further step may be taken of extending fasteners 38 transversely through teeth 34 of one slab 28*a*, 28*b* and 28*c* and into a bottom of slot 36 of another slab 28*a*, 28*b* and 28*c* to maintain teeth 34 engaged with slots 36. It is anticipated that in short installations a single slab length will be sufficient. However, to facilitate longer installations, each slab may be comprised of slab segments. Referring to FIG. 3, each of the slabs 28*a*, 28*b* and 28*c* may include more than one slab segment 40 and a step is taken of positioning the slab segments 40 in end to end relation. Referring to FIG. 2, a joint 42 is created whenever one slab segment 40 abuts another slab segment 40 in end to end relation. Joints 42 connecting the slab segments 40 of the three discrete slabs 28*a*, 28*b* and 28*c* may be offset so that joints 42 do not line up and provide increased structural support. If desired, joints 42 can be made interlocking, by using a joint that will resist longitudinal separation, such as a dove tail style of joint. It is believed that leakage through joints 42 will be negligible. However, if leakage is a concern, a water resistant top coat can be applied after assembly.

Operation:

Referring to FIG. 3, slab segments 40 making up slabs 28, are transported on site and assembled in situ to form triangular bodies 12. Referring to FIG. 4, the assembly involves interlocking interlocking profiles 32 of the dog-clutch engagement by positioning teeth 34 into slots 36. Fasteners 38 are then extended transversely through teeth 34 of one slab 28*a*, 28*b* and 28*c* and into a bottom of slot 36 of another slab. Referring to FIG. 1 and FIG. 5, two or more three-sided elongated triangular bodies 12 are then positioned in a body of water 44 in side by side relation with the flow passages 18 of one or more of triangular bodies 12 serving as a flow path for water. Referring to FIG. 5, triangular bodies 12 may be positioned such that each triangular body 12 rests on base 22 with apex 20 extending upwards. Referring to FIG. 1, triangular bodies 12 may be positioned such that triangular bodies 12 are alternated with apex 20 of one triangular body 12 extending upwardly and apex 20 of an adjacent triangular body 12 extending downwardly. The preferred manner of installation is as shown in FIG. 1, with such an installation it is preferred that an odd number of triangular bodies be employed. If three triangular bodies were used, two would be apex up and the third would be in between apex down. If five triangular bodies were used, three would be apex up and the other two would be placed in between apex down. The odd number configuration enables better compaction and supports the apex down triangular body on each side with an apex up triangular body. Referring to FIG. 6 and FIG. 6, a road, a bridge or a dock 24 is then positioned transversely across triangular bodies 12.

Advantages:

1. Water flow is at maximum flow availability at the start of flow rather than at 50% as in a round pipe.

2. The interlocking system in this triangular configuration will sustain the greater forces required for road compaction to support the heavy loads of today's traffic unlike that of previous designs.

3. The flat base of the triangle can be installed to mimic the water flow bed thus limiting the adverse effect on wildlife as in any flat base culvert.

4. By placing multiple Triangle Culverts together, a bridge effect can be achieved without having to align the road grade to the riverbed, as in a normal bridge.

5. By using a larger number of triangular culverts linked together, a lower elevation of road grade can be achieved. This is achieved because of the structural strength of the Castle lock system in a triangular form.

6. The dog-clutch (also referred to as castle lock) interlocking system allows for a substantial decrease in the installation time as compared to a round multi-plate type culvert or an onsite structural cement poured culvert.

7. The Triangle Culverts can be removed and reused at a later date as required, or extended in length with minimum disruption to the road grade.

8. A variety of materials can be used in this design to give a longer culvert life than the traditional round metal pipe systems.

Variations

It will be appreciated that the teachings set forth above are equally applicable to partially submerged buoyant structures. In such installations, flow passages 18 accommodate water flow through a lower portion of the partially submerged buoyant structure. For example, a dock or floating bridge may be a partially submerged buoyant structure.

It will also be appreciated that there may be multiple vertical layers of triangular bodies 12 to suit installation requirements. For example, multiple vertical layers may be required for deep bodies of water to provide a sufficient flow area through flow passages to accommodate the depth and volume of water. It may also be advisable in areas that are subject to flash floods, where a great volume of water may periodically flow through a normally dry gully in a short period of time.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with the description as a whole.

What is claimed is:

1. A method of building a structure in the presence of water, the method comprising the steps of:

providing two or more three-sided elongated triangular bodies having a first end, a second end, and an internal flow passage that extends between the first end and the second end, each of the triangular bodies having an apex with a base located opposed to the apex, positioning each of the triangular bodies in side by side relation on a body of water in alternating orientations such that at least one triangular body is inverted and such that the at least one inverted triangular body is supported by an adjacent triangular body, the apex and the base of side by side triangular bodies are located adjacent one another, with the flow passage of one or more of the triangular bodies serving as a flow path for water;

positioning one of a floating bridge or a dock transversely across the base of the at least one inverted triangular body such that the floating bridge or dock is supported on the base and supported above the body of water at least partially by the triangular bodes such that the triangular bodies are at least partially submerged and the water is permitted to traverse the floating bridge or dock through the triangular bodies.

2. The method of claim 1, wherein two or more of the triangular bodies are upright such that the upright triangular bodies rest on the base with the apex of each of the triangular bodies extending upwardly and one or more triangular bodies are inverted and positioned between pairs of upright triangular bodies such that the base extends upwardly.

3. The method of claim 1, wherein each of the triangular bodies has a longitudinal axis and the positioning of the triangular bodies is closely spaced with the longitudinal axis of each of the triangular bodies in parallel spaced relation.

4. The method of claim 1, wherein each of the triangular bodies are comprised of three discrete slabs having side edges with interlocking profiles and a step is taken of interlocking the interlocking profiles of the side edges to form the triangular bodies.

5. The method of claim 4, wherein each of the interlocking profiles is a dog-clutch engagement having teeth which engage slots.

6. The method of claim 5, wherein a step is taken of extending fasteners transversely through the teeth of one slab and into a bottom of a slot of another slab to maintain the teeth engaged with the slots.

7. The method of claim 4, wherein each of the slabs is comprised of more than one slab segment and a step is taken of positioning the slab segments in end to end relation.

8. The method of claim 7, wherein a joint is created whenever one slab segment abuts another slab segment in end to end relation, and a step is taken of offsetting the joints connecting the slab segments of one of the three discrete slabs relative to the joints connecting the slab segments on other of the three discrete slabs.

9. The method of claim 1, wherein the road, bridge or dock traverses the triangular bodies at an angle of less than 90 degrees or more than 90 degrees in relation to the triangular bodies.

10. The method of claim 1, wherein the triangular bodies positioned in side by side relation are oriented in two or more vertical layers.

* * * * *